US006666662B2

(12) United States Patent
Oh et al.

(10) Patent No.: US 6,666,662 B2
(45) Date of Patent: Dec. 23, 2003

(54) STATOR SUPPORTING APPARATUS FOR RECIPROCATING COMPRESSOR

(75) Inventors: Won-Sik Oh, Seoul (KR); Ki-Chul Choi, Gyunggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/031,400

(22) PCT Filed: May 19, 2001

(86) PCT No.: PCT/KR01/00828

§ 371 (c)(1),
(2), (4) Date: Feb. 27, 2002

(87) PCT Pub. No.: WO01/88373

PCT Pub. Date: Nov. 22, 2001

(65) Prior Publication Data

US 2002/0122732 A1 Sep. 5, 2002

(30) Foreign Application Priority Data

May 19, 2000 (KR) ..... 2000-27097

(51) Int. Cl.[7] ..... F04B 35/04
(52) U.S. Cl. ..... 417/417
(58) Field of Search ..... 417/363, 417

(56) References Cited

U.S. PATENT DOCUMENTS

| | | | | | |
|---|---|---|---|---|---|
| 2,988,264 | A | | 6/1961 | Reutter | |
| 3,171,585 | A | | 3/1965 | Gauss | |
| 3,325,085 | A | | 6/1967 | Gaus | |
| 4,374,330 | A | * | 2/1983 | Fey | 417/417 |
| 4,416,594 | A | * | 11/1983 | Ichikawa | 417/417 |
| 5,993,175 | A | * | 11/1999 | Kim et al. | 417/417 |
| 6,174,141 | B1 | * | 1/2001 | Song et al. | 417/417 |
| 6,491,506 | B1 | * | 12/2002 | Oh et al. | 417/417 |

* cited by examiner

*Primary Examiner*—Michael Koczo
(74) *Attorney, Agent, or Firm*—Birch, Stewart, Kolasch & Birch, LLP

(57) ABSTRACT

A stator (4A) supporting apparatus for a reciprocating compressor includes a cap member (10), in which one end of an inner resonance spring (7A) abuts to one end of the cap member (10) so that the vibration of the inner resonance spring (7A) is transferred to the stator, and the cap member (10) is isolated from the frame of the compressor so as to prevent the vibration of the inner resonance spring (7A) from transferring to the frame (1) directly. Therefore, the vibration of the compressor is reduced by fixing the inner stator (4A) strongly and transferring the vibration generated in the inner resonance spring (7A) to the frame through the inner stator (4A).

7 Claims, 6 Drawing Sheets

STATOR SUPPORTING APPARATUS FOR RECIPROCATING COMPRESSOR

TECHNICAL FIELD

This application is the national phase under 35 U.S.C. §371 of PCT International Application No. PCT/KR01/00828 which has an International filing date of May 19, 2001, which designated the United States of America and was published in English.

The present invention relates to a stator supporting apparatus for a reciprocating compressor, and particularly, to a stator supporting apparatus for a reciprocating compressor which is capable of strongly fixing an inner stator and attenuating vibration of the compressor.

BACKGROUND ART

FIG. 1 is a transverse, cross-sectional view of an examplary conventional reciprocating compressor of the moving magnet type. Generally, a reciprocating compressor is constructed such that a piston of the compressor is integrally combined with the armature (moving element) of a reciprocating electric motor, instead of using a crank shaft.

As shown in FIGS. 1 and 2, a conventional reciprocating compressor includes a compressor unit (C) installed extending transversely inside a casing (V) filled at the bottom with lubricant, the compressor unit sucking refrigerant, compressing and discharging the sucked refrigerant, and a lubricant feeder, (O) is fixed outside the compressor unit (C) for supplying lubricant to sliding parts of the compressor unit (C).

The compressor unit (C) includes an annular frame 1, a cover 2 fixedly installed at a one end of the frame 1, a cylinder 3 fixed transversely in a central part of the frame 1, an inner stator 4A fixed in an inner part of the frame 1 supporting the cylinder 3 and an outer stator 4B fixed in an outer part of the frame 1 and spaced radially outwardly from inner stator 4A by a certain gap; an armature 5 having a permanent magnet disposed in the gap between the inner and the outer stators 4A and 4B; a piston 6 fixed integrally on the armature 5 and sucking/compressing the refrigerant gas by performing sliding movement inside the cylinder 3; a pair of inner and outer resonance springs 7A and 7B elastically assisting the continuous resonant movement of the armature 5 in the gap between the inner and outer stators 4A and 4B; and a discharge valve assembly 8 installed on a front end of the cylinder 3.

Hereinafter, the left side of the Figures represents the front side, and the right side of the Figures represents the rear side.

The inner stator 4A is formed by stacking a plurality of stator core laminations 4*a* side-by-side to form a cylindrical shape, and the inner surface of the inner stator 4A is coupled to the outer surface of the frame by being press fitted into the frame, and at the same time, the front end of the inner stator 4A abuts a stepped surface 1*a* of the frame 1 so as to be supported thereby.

Reference numeral 9 designates a suction valve, and reference SP designates a suction pipe.

The above-described conventional reciprocating compressor is operated as follows.

That is, when an alternating electric current is applied to the coil carried by the outer stator 4B and an alternating magnetic field is generated between the inner and outer stators 4A and 4B, the armature 5 undergoes linear reciprocating movement as the poles of the permanent magnet thereof are alternatingly attracted and repulsed by the magnetic field in the gap, whereby the piston 6 coupled to the armature 5 also undergoes linear reciprocating motion inside the cylinder 3 so that a pressure variance is repeatedly generated inside the cylinder 3. Accordingly, due to the pressure variance inside the cylinder 3, the refrigerant gas in the casing (V) is sucked into the cylinder through the gas flowing passage (F) in the piston 6, then compressed and discharged through the discharge valve assembly 8. And this process is repeated continually as the piston is shuttled in the cylinder.

At this time, as the armature 5 undergoes linear motion in the transverse direction (in the drawing) due to the alternating magnetic fields generated in the gap between the inner and outer stators 4A and 4B, the inner and the outer resonance springs 7A and 7B supporting the armature in both directions are compressed and stretched oppositely to each other, causing the armature's reciprocation to be resonated.

However, in the conventional reciprocating compressor as described above, only the front end of the inner stator is supported by the frame, and the rear end of the inner stator is left free as it is, and therefore the inner stator cannot be fixed strongly.

Also, a vibration is generated while the inner and the outer resonance springs resonate the movement of the armature, and the compressor unit is vibrated thereby because the inner resonance spring is abutted to the frame directly and supported thereat, and accordingly, vibration of the reciprocating compressor itself inside the casing is increased.

SUMMARY OF THE INVENTION

Therefore, it is an object of the present invention to provide a stator supporting apparatus for a reciprocating compressor which can fix the inner stator strongly in order to solve the problems of the conventional art.

Also, it is another object of the present invention to provide a stator supporting apparatus for a reciprocating compressor which can prevent of vibration of the compressor unit by the inner resonance spring when the inner and the outer resonance springs supporting the armature are compressed and stretched.

To accomplish these objects of the present invention, there is provided a reciprocating compressor comprising a frame supporting a cylinder is installed elastically inside a casing; an inner stator and an outer stator constituting a stator of a motor are installed on the frame; an armature coupled integrally to a piston, which is inserted slidably into the cylinder, is disposed with a certain gap between the inner stator and the outer stator; and an inner resonance spring and an outer resonance spring supports the from front and rear sides of the armature so that the armature undergoes linear resonant movement with the piston; wherein a stator supporting apparatus for the reciprocating compressor in which one side end of the inner stator fixed on the frame is supported by a supporting member, and the other end part of the supporting member is elastically supported by one end of the inner resonance spring, so that the vibration of the resonance spring is transferred to the frame through the inner stator is provided.

Also, to accomplish these objects of the present invention, there is provided a stator supporting apparatus for a reciprocating compressor comprising a frame elastically supported in a casing; a cylinder fixedly installed on the frame; an inner stator and an outer stator fixedly installed on the frame and constructing a stator in a motor; an armature coupled integrally with a piston inserted into the cylinder slidably, and disposed in air gap generated between the inner stator and the outer stator; an inner resonance spring and an outer resonance spring supported from both front/rear sides of the armature so that the armature is able to undergo linear reciprocating movement with the piston; and a supporting member in which an inner bent-up part supporting one end of the inner resonance spring and an outer bent-up part supporting one side of the inner stator are formed as a single body, whereby vibration of the inner/outer resonance springs is able to be transferred to the frame through the inner stator when the motor is operated.

DETAILED DESCRIPTION OF THE PREFERRED EMBODIMENTS

Figure 1:
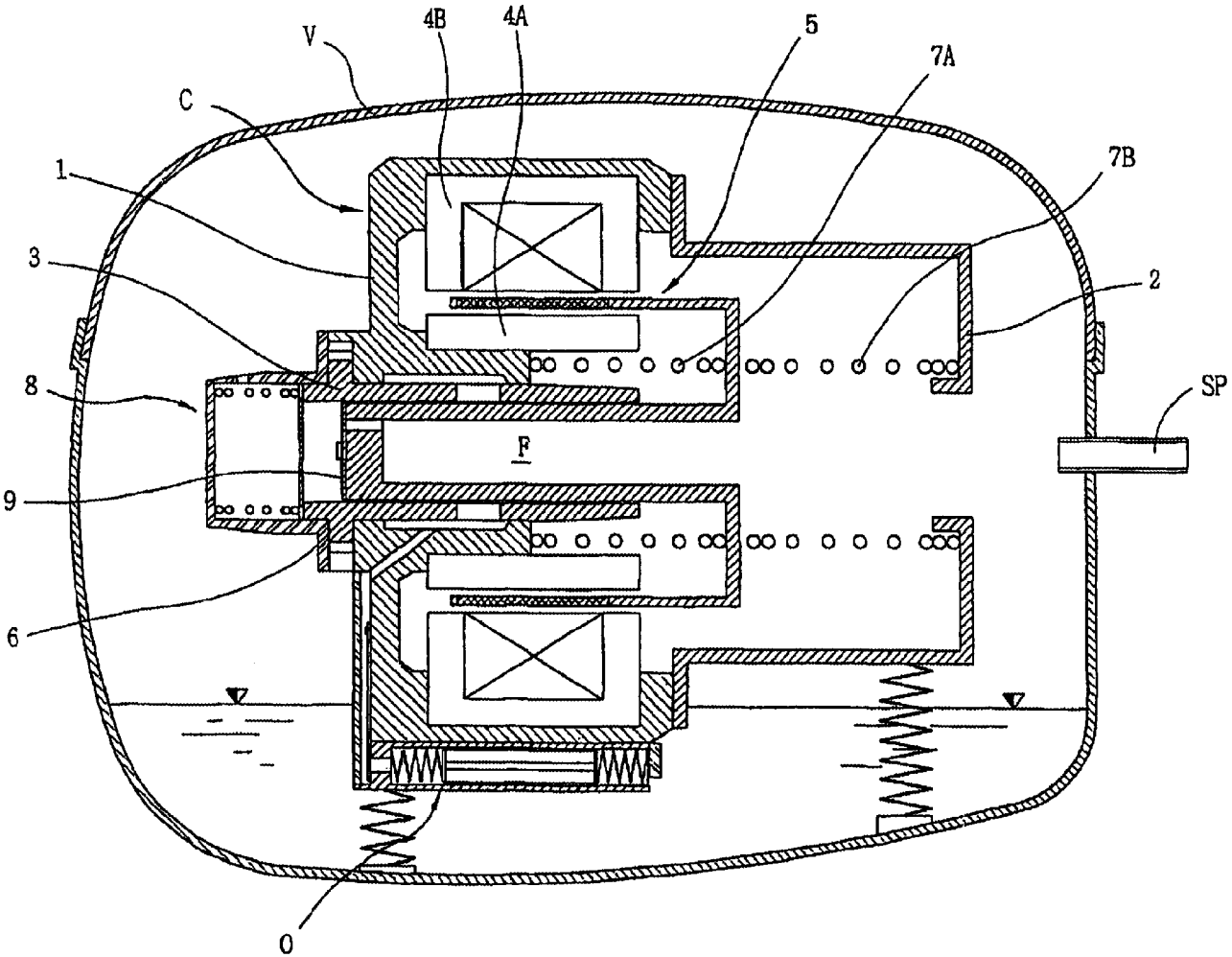
FIG. 1 PRIOR ART
FIG. 1 is a transverse cross-sectional view showing a conventional reciprocating compressor.
Figure 2:
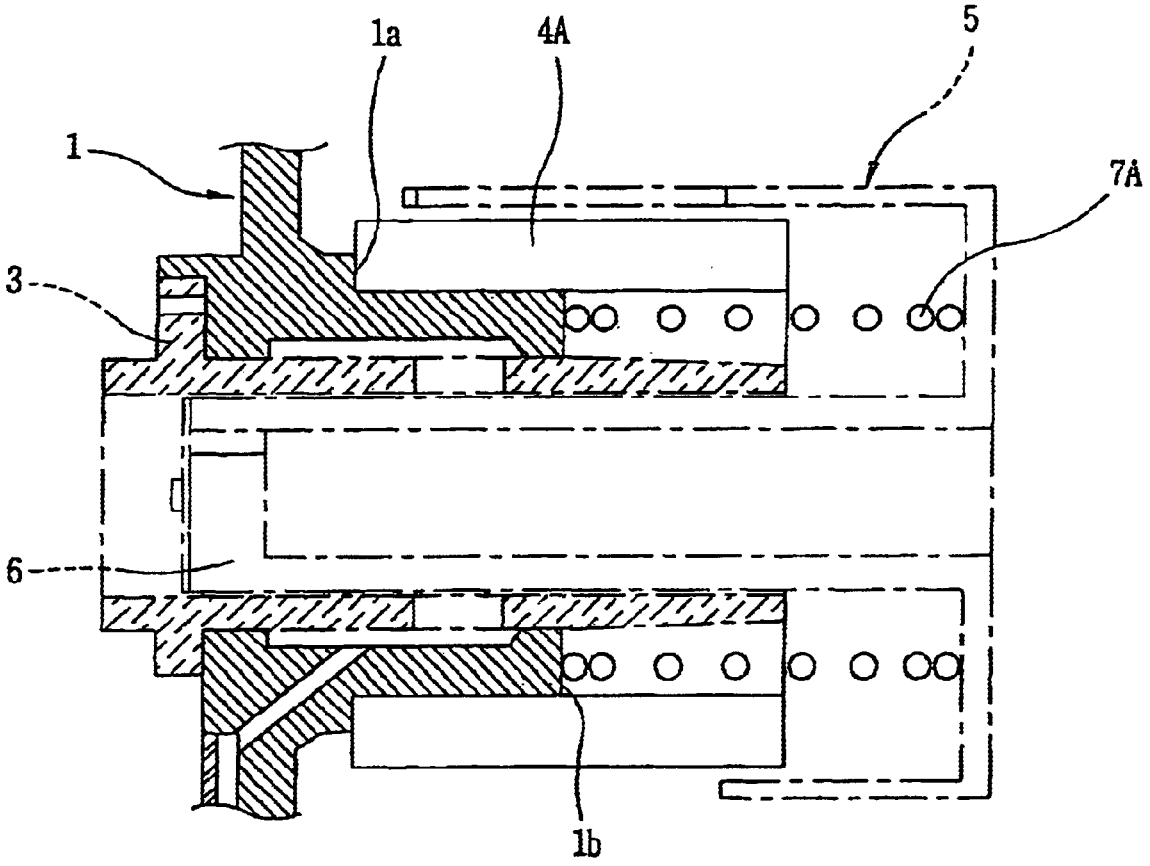
FIG. 2 PRIOR ART
FIG. 2 is a cross-sectional view showing the fixing structure of an inner stator in the conventional reciprocating compressor.

The stator supporting apparatus for a reciprocating compressor according to the present invention will be described with reference to the accompanying drawings.

The same components as those of the conventional art are designated by the same reference numerals.

Figure 3:
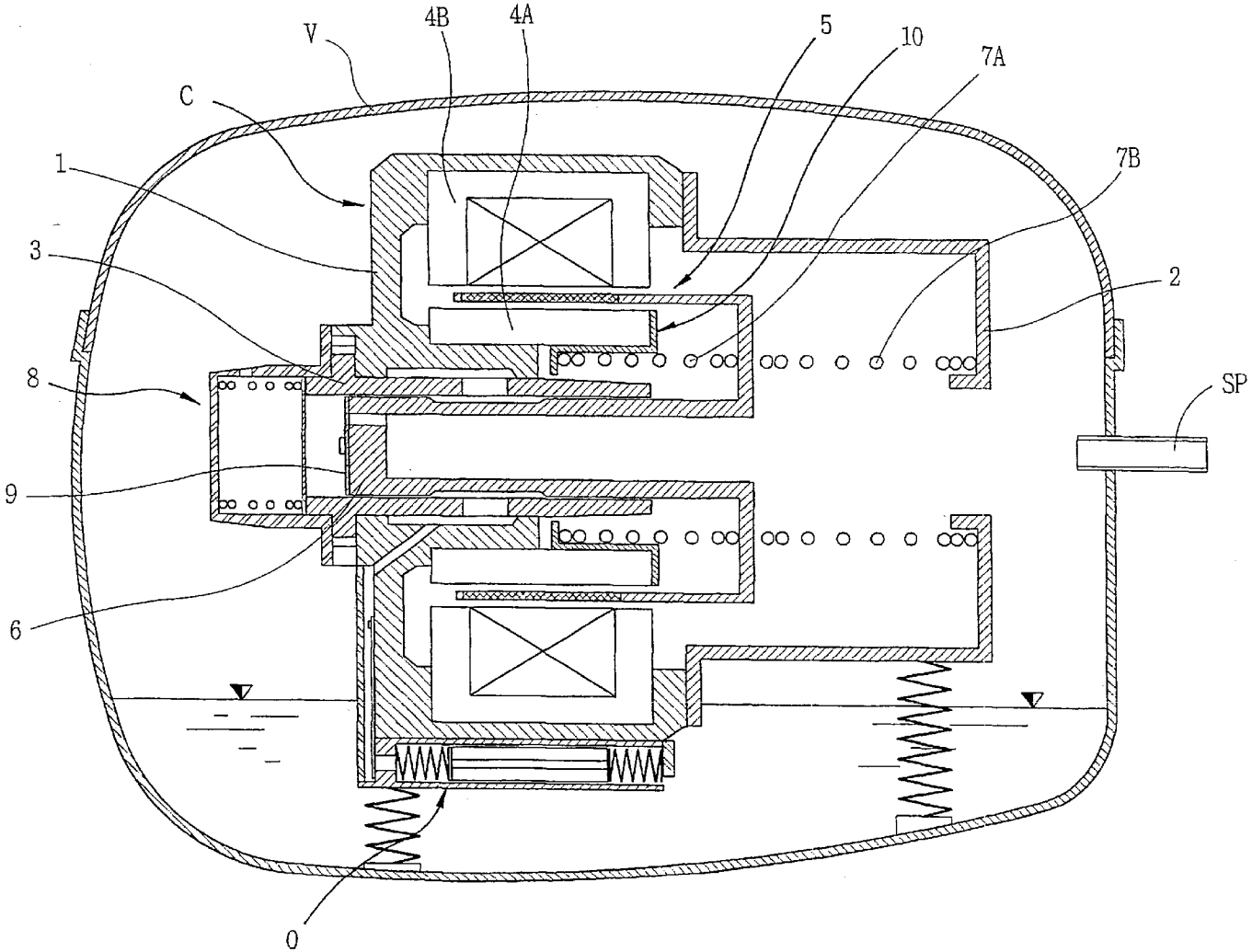
FIG. 3 is a transverse cross-sectional view showing an embodiment of a reciprocating compressor according to the present invention.
Figure 4:
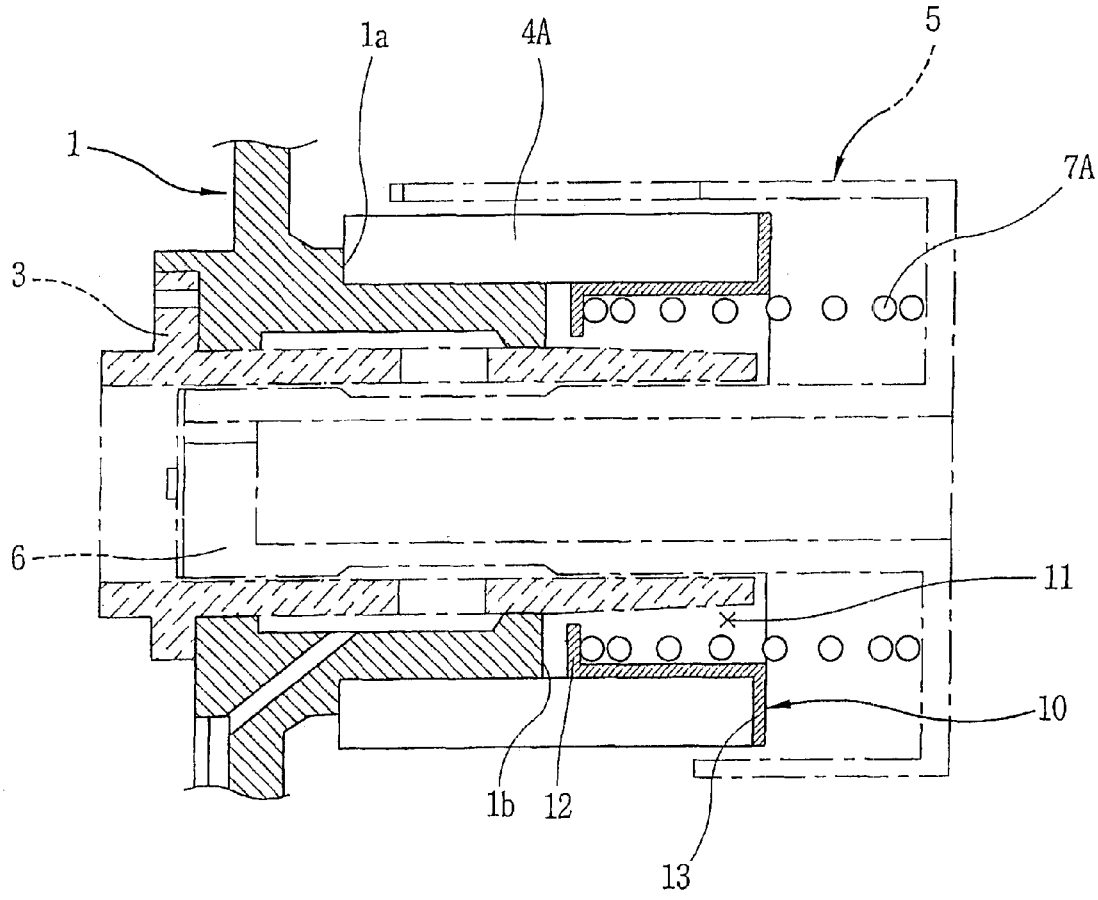
FIG. 4 is a cross-sectional view showing the fixing structure of the inner stator in the reciprocating compressor according to the present invention.

As shown in FIGS. 3 and 4, a reciprocating compressor, to which a stator supporting apparatus according to the present invention is adapted, includes a casing (V) filled with lubricant at the bottom, and fitted with a suction pipe SP and an exhaust pipe(not shown); a frame 1 of annular shape elastically supported within the casing (V); a cover 2 fixed on an end surface of the frame 1; a cylinder 3 fixed in a central part of the frame 1 in the axial direction; an inner stator 4A fixed on the inner part of the frame 1; an outer stator 4B fixed on an outer part of the frame 1 and spaced from the inner stator 4A by a certain radial gap; an armature 5 carrying a permanent magnet disposed in the gap between the inner stator 4A and the outer stator 4B and capable of performing linear reciprocating movement therein; a piston 6 fixed integrally on the armature 5, inserted slidably into the cylinder, and capable of linear reciprocating movement together with the armature 5; an inner resonance spring 7A and an outer resonance spring 7B supporting the armature 5 from both sides of the armature 5 and inducting the resonant movement of the armature 5; and a supporting member comprising a cap member 10 disposed between the inner resonance spring 7A and the inner stator 4A, and elastically supporting the inner stator 4A.

The inner stator 4A is formed by stacking a plurality of stator core laminations 4*a* side-by-side to have a cylindrical shape, and the front end of the inner stator 4A abuts against a step 1*a* formed in the outer surface of the frame 1 so as to be fixed in the frontward direction, but at the other, rear end of the inner stator 4A, the cap member 10 being pressed elastically by the inner resonance spring 7A is abutted and supported.

Therefore, the cap member 10 itself performs as a spring base supporting the inner resonance spring elastically.

Figure 5:
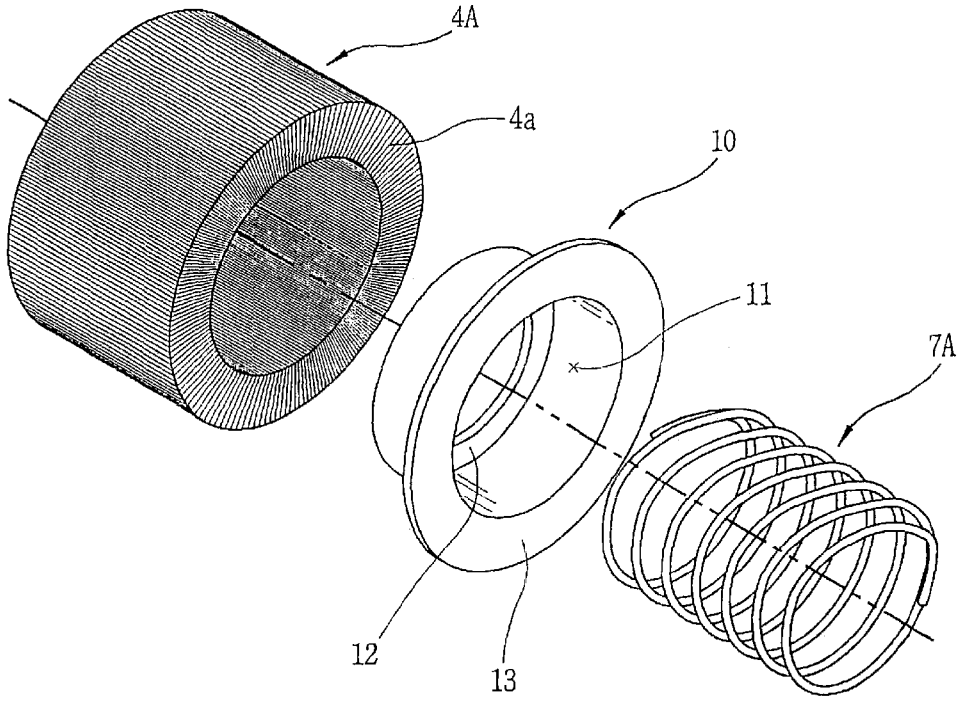
FIG. 5 is an exploded perspective view showing the fixing structure of the inner stator in the reciprocating compressor according to the present invention.

The cap member 10, as shown in FIG. 5, is formed as a cylindrical 'cap' having a central cylindrical bore 11, an inner bent-up part 12 at its one end, and an outer bent-up part 13 at its other end, and the cylinder 3 is extends through the bore 11 with a certain gap, so that the inner resonance spring 7A can be disposed between the inner surface of the bore 11 and the outer surface of the cylinder 3. In addition, the front end of the inner resonance spring 7A is abutted against and supported by the inner bent-up part 12 of the cap member 10, and the rear end of the inner stator 4A is abutted by and supported by the outer bent-up part 13 of the cap member 10.

Also, in consideration of contacting of the cap member 10 with the inner resonance spring 7A undergoing a vibration, it is desirable that the front inner bent-up part 12 of the cap member 10 is spaced with a certain gap from the frame 1 so that the inner bent-up part 12 is not contacted with the rear end 1*b* of the frame 1.

Figure 6:
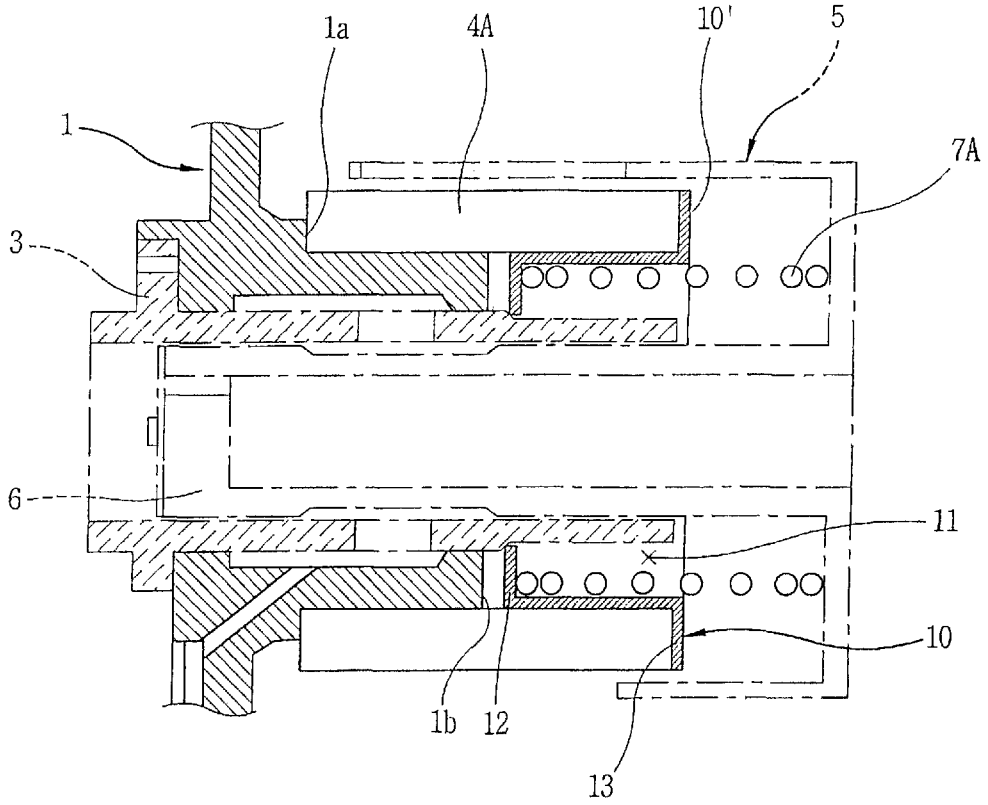
FIG. 6 is a cross-sectional view showing another embodiment of the fixing structure of the inner stator in the reciprocating compressor according to the present invention.

Also, as another embodiment of the stator supporting apparatus for a reciprocating compressor according to the present invention, the cap member 10' may be constructed so as to contact the cylinder 3 and the inner stator 4A at the same time, or the cap member 10' may have a part which contacts the cylinder 3 and the inner stator 4A at the same time. In FIG. 6, a construction where the cap member 10' contacts the outer surface of the cylinder 3 and the rear end of the inner stator 4A is shown. Accordingly, the fixing of the inner stator can be made stronger and more rigid.

In addition, the cap member 10' is fabricated by a sheet metal forming process using a press machine.

The general operation of the reciprocating compressor having the stator supporting apparatus according to the present invention is similar to that of the conventional art.

That is, when the armature 5 undergoes linear reciprocating movement after the electric current is applied to the coil carried by the outer stator 4B, the piston coupled to the armature 5 performs linear reciprocating movement inside the cylinder, whereby the pressure inside the cylinder is differentiated, so the refrigerant gas inside the casing (V) is sucked into the cylinder 3 through the gas flowing passage (F) in the piston 6, then compressed and discharged through the discharge valve assembly 8.

At that time, if the armature 5 undergoes the linear reciprocating movement in the transverse axial direction in the gap between the inner and outer stators 4A and 4B, the inner resonance spring 7A among inner and outer resonance springs 7A and 7B supporting-the armature 5 from both sides presses against the cap member 10, so that the cap member 10 pressed by the inner resonance spring pushes against the rear end-of the inner stator 4A towards the frontward direction, whereby the inner stator 4A is abutted against the step 1*a* of the frame more strongly.

That is, the front end of the inner stator 4A is fixed on the step 1*a* formed on the outer surface of the frame 1, and in that state, the rear end of the inner stator 4A is pushed in the frontward direction by the cap member 10 pressed by the inner resonance spring 7A, whereby the inner stator can be fixed more strongly.

Also, the front end of the cap member 10 is not disposed directly on the rear end 1*b* of the frame 1, and therefore the vibration of the inner resonance spring 7A abutted to the cap member 10 is not transferred directly to the frame 1, but is transferred to the frame 1 through the inner stator 4A.

Because the inner stator 4A is constructed by stacking a plurality of stator core laminations 4*a*, the vibration is compensated to a certain level by the inner stator 4A and then transferred to the frame 1, whereby the vibration of the compressor can be reduced.

As so far described, according to the present invention, the inner stator for a reciprocating compressor comprises a cap member adhering to the one side of the inner stator assembly corresponding to the one end of the inner resonance spring, the inner resonance spring, which is adhered to the other side of the cap member, elastically supporting the inner stator and at the same time making the exciting force transfer to the inner stator, and the cap member is disposed so as to be apart from the frame thereby direct transferring of the exciting force generated in the inner resonance spring to the frame is prevented. Therefore, the inner stator can be fixed strongly, and the exciting force generated during the compression or stretching process of the inner resonance spring is transferred to the frame through the inner stator, thereby the vibration of the compressor can be reduced.

The invention has applicability to reciprocating motors and compressors as are employed widely in various industrial fields including refrigeration and air conditioning devices.

What is claimed is:

1. A reciprocating compressor comprising:

a frame supporting a cylinder, the frame being installed elastically inside a casing;

a radially inner stator and a radially outer stator installed on the frame and forming a stator of a motor;

an armature coupled integrally to a piston, which is slidably inserted into the cylinder, the armature being disposed with a certain gap between the inner stator and the outer stator;

an inner resonance spring and an outer resonance spring supporting front and rear sides of the armature so that the armature undergoes linear resonant movement with the piston; and a stator supporting apparatus including a supporting member, one end of the inner stator being supported by the supporting member, the supporting member being elastically supported by one end of the inner resonance spring, so that the vibration of the resonance spring is transferred to the frame through the inner stator.

2. The apparatus according to claim 1, wherein the supporting member is a cap member providing a spring base for elastically supporting the inner resonance spring.

3. A stator supporting apparatus for a reciprocating compressor comprising:

a frame elastically supported in a casing;

a cylinder fixedly installed on the frame;

a radially inner stator and a radially outer stator fixedly installed on the frame and forming a stator in a motor;

an armature coupled integrally with a piston slidably inserted into the cylinder, and disposed in an air gap formed between the inner stator and the outer stator;

an inner resonance spring and an outer resonance spring supported from the armature so that the armature is able to undergo linear reciprocating movement with the piston; and a supporting member in which an inner bent-up part supporting one end of the inner resonance spring and an outer bent-up part supporting one side of the inner stator are formed as a single body, whereby vibration of the inner and outer resonance springs is able to be transferred to the frame through the inner stator when the motor is operated.

4. The apparatus according to claim 3, wherein the supporting member is a cap member constructed so that supporting surfaces of the outer bent-up part and of the inner bent-up part comprise different surfaces.

5. The apparatus according to claim 4, wherein the cap member is made of sheet metal.

6. The apparatus according to claim 4, wherein the cap member is disposed apart from the frame, whereby the vibration of the inner resonance spring is not directly transferred to the frame.

7. The apparatus according to claim 4, wherein the cap member includes a part which is contacted to the cylinder and to the inner stator, at the same time.

* * * * *